US008225805B2

(12) United States Patent
Wu et al.

(10) Patent No.: US 8,225,805 B2
(45) Date of Patent: Jul. 24, 2012

(54) PROTECTIVE MEMBER FOR AUTOMATIC OPEN CLOSE UMBRELLA WITH ANTI-SPRINGING EFFECT

(75) Inventors: Tsun-Zong Wu, Wugu Township, Taipei County (TW); Hsien-Jung Chen, Wugu Township, Taipei County (TW)

(73) Assignee: Tsun-Zong Wu, Taipei County (TW)

( * ) Notice: Subject to any disclaimer, the term of this patent is extended or adjusted under 35 U.S.C. 154(b) by 0 days.

(21) Appl. No.: 12/749,096

(22) Filed: Mar. 29, 2010

(65) Prior Publication Data

US 2011/0232707 A1 Sep. 29, 2011

(51) Int. Cl.
*A45B 25/14* (2006.01)
*A45B 25/16* (2006.01)

(52) U.S. Cl. ..... 135/24; 135/20.3; 135/25.4

(58) Field of Classification Search ..... 135/20.3, 135/22, 24, 25.1, 25.4
See application file for complete search history.

(56) References Cited

U.S. PATENT DOCUMENTS

| | | | | |
|---|---|---|---|---|
| 7,798,160 | B2 * | 9/2010 | Chen | 135/24 |
| 7,971,595 | B1 * | 7/2011 | Ko | 135/24 |
| 2009/0133729 | A1 * | 5/2009 | Chong | 135/20.3 |
| 2010/0319739 | A1 * | 12/2010 | Chong | 135/24 |
| 2011/0048479 | A1 * | 3/2011 | Kuo | 135/20.3 |
| 2011/0114142 | A1 * | 5/2011 | Cai | 135/22 |

FOREIGN PATENT DOCUMENTS

| | | |
|---|---|---|
| CN | 101438877 | 5/2009 |
| CN | 201303659 | 9/2009 |
| CN | 101642319 | 2/2010 |
| CN | 101653309 | 2/2010 |
| JP | 2009125581 | 6/2009 |
| TW | M358556 | 11/2008 |

* cited by examiner

*Primary Examiner* — David Dunn
*Assistant Examiner* — Danielle Jackson
(74) *Attorney, Agent, or Firm* — Muncy, Geissler, Olds & Lowe, PLLC

(57) ABSTRACT

A protective device for automatic open close umbrellas is revealed. The protective device includes a ratchet mounted in a handle and rotating elastically for retracting or releasing a string, a string whose bottom end is fixed on the ratchet while a top end is fixed on an outer tube of an umbrella shaft or a core tube, and a locking member that is reverse L-shaped and is arranged with an elastic member for turning back therein. The locking member includes an upper part, a lower part, and a middle axle, used as a first-class lever. The upper part is against the bottom of the umbrella shaft so that the fastener can lean against a top surface of the upper part. When the umbrella shaft is gradually folded, the top surface of the upper part of the locking member is separated from the fastener while the bottom of the lower part is locked to one of the ratchet teeth of the ratchet elastically so as to achieve anti-springing effect.

10 Claims, 12 Drawing Sheets

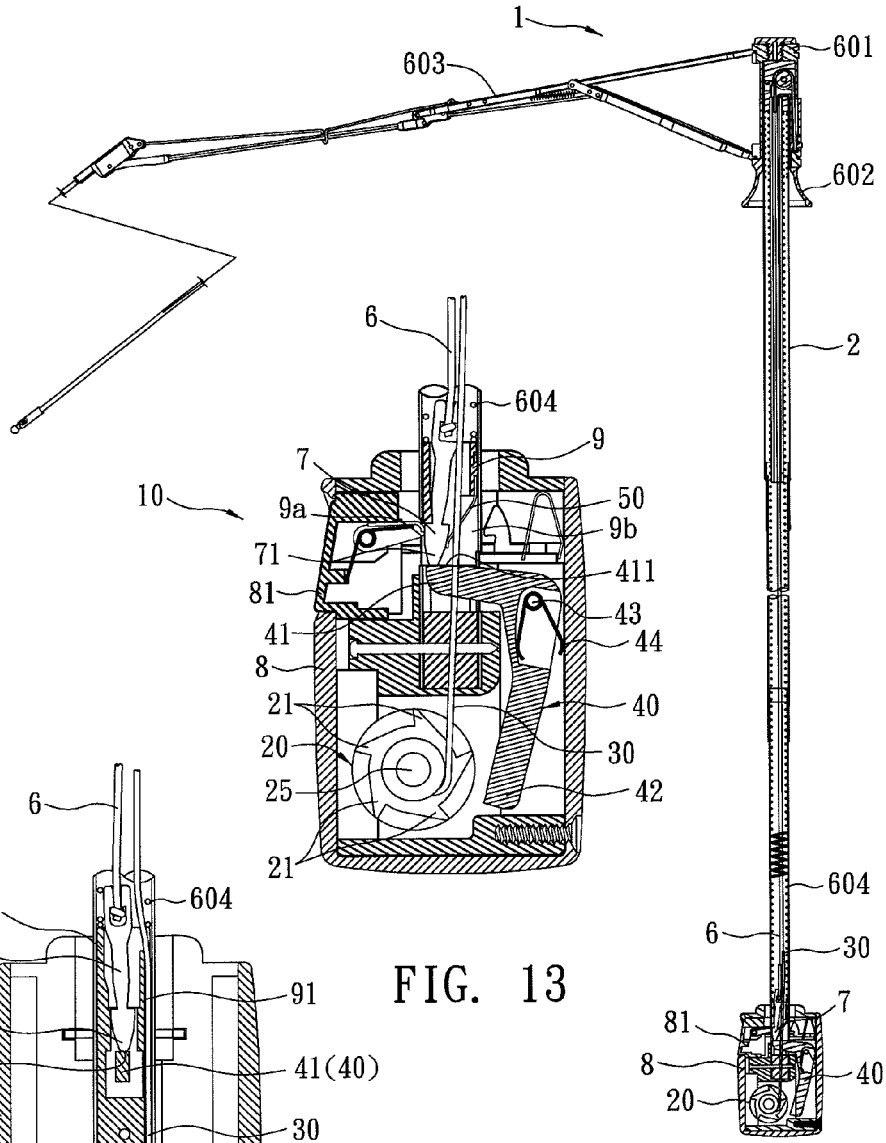
FIG. 13
FIG. 12
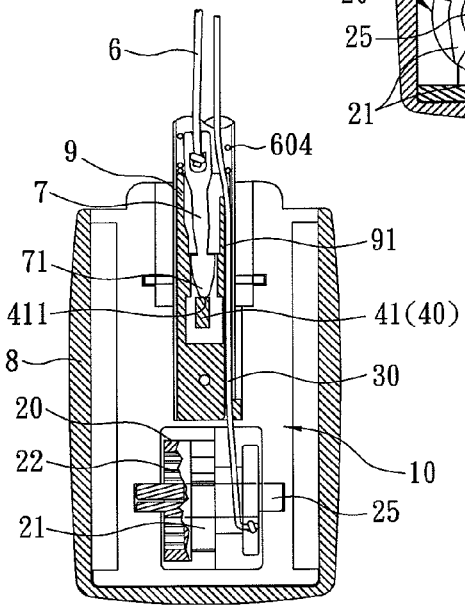
FIG. 14

PROTECTIVE MEMBER FOR AUTOMATIC OPEN CLOSE UMBRELLA WITH ANTI-SPRINGING EFFECT

BACKGROUND OF THE INVENTION

The present invention relates to a protective member for automatic open close umbrellas, especially to a protective member for automatic open close umbrellas with anti-springing effect that prevents an umbrella shaft from springing back effectively when a force applied to the umbrella shaft disappears suddenly.

The automatic open close umbrella available now opens and closes umbrella frames by pressing a button on a handle. While closing the umbrella, users need to slide down an umbrella shaft toward the handle so as to shorten the umbrella shaft to a locating point for being locked. That's the closed state. While during closing process of the umbrella shaft, the force applied to the umbrella shaft may suddenly disappear due to improper operations and the umbrella shaft is stretched out and users may get hurt. The followings are prior arts of protective members for automatic open close umbrellas.

Refer to FIG. 1, a protective member for automatic open close umbrellas is disclosed in Chinese Pat. No. 101642319A. A top end of an anti-springing rope 101 is fixed on a pulley seat and a bottom end thereof is inserted through an inner tube and an inner space of a bullet head 110 to be wound around a ratchet 102. However, the mounting of the inner space in the bullet head 110 increases manufacturing procedures and the strength of the bullet head 110 is reduced. Moreover, the bullet head 110 and an anti-springing stopper 105 form a third-class lever. That means the fulcrum at one end of the lever and a force is applied between the fulcrum and the load. Thus the bullet head 110 needs to be applied with a larger force for pushing the anti-springing stopper 105 releasing from the ratchet 102. Thus the bullet head 110 is worn out easily and the anti-springing stopper 105 is displaced. The anti-springing effect is lost and users may get hurt.

Refer to FIG. 2, a protective member for automatic open close umbrellas is disclosed in Chinese Pat. No. 101438877A. A top end of a anti-springing rope 202 is fixed on an upper runner on top of an umbrella shaft while a bottom end is fixed on a jigger 201. However, the device has complicated structure—such as disposition of a clutch so that the assembling is difficult, time and labor-consuming. Thus the cost is increased. Moreover, the corresponding movement of each component causes wear that may lead to loss of anti-springing effect.

Refer to FIG. 3, a protective member for automatic open close umbrellas is disclosed in Japanese Pub. No. 2009-125581 and US Pub. No. 2009/0133729A1. A top end of a rope 301 is penetrated through a top surface of an umbrella handle 300 and is along a lateral side of an umbrella shaft 303 to be connected with an upper runner while a lower end of the rope 301 is fixed on a jigger 302. However, in such design, the rope is easy to be wound with another rope. Moreover, the rope exposed on outer surface of the umbrella shaft 303 is easy to wear and the use life is reduced. Thus there is a risk to lose the anti-springing effect.

Refer to FIG. 4, a protective member for automatic open close umbrellas revealed in Chinese Pat. No. 101653309A is similar to the one in Chinese Pat. No. 101438877A due to the same applicant, except a ratchet 401 and a pawl 402 are used to replace the jigger 201 and the clutch. However, a linkage 404 and the pawl of the present invention form a third-class lever. Thus the linkage 404 is applied with a larger force so as to push the pawl separating from the ratchet. Moreover, a fastener 403 is arranged with an insertion hole that allows a rope 405 to pass. Thus the manufacturing processes are increased and the strength of the fastener is decreased. Furthermore, an opening is on a bottom of the fastener 403 and this leads to friction and wear between it and an opening on top of the linkage 404. Thus the use life is reduced and the anti-springing effect is easy to lose.

As shown in FIG. 5, a protective member for automatic open close umbrellas revealed in Chinese Pat. No. 201303659Y and Taiwanese Pat. No. M358556, a stopping rope 503 includes a connection end that connects with a rotating disc and an involving end that connects with one of an upper runner and a connecting unit. However, the complicated structure of the present invention increase difficulty in assembling. Thus the assembling is time- and labor-consuming so that the cost is increased. Moreover, the handle requires a larger volume so that the size of the umbrella is increased. This is not convenient for carrying and operation.

Although the above prior arts all provide anti-springing effect, they have following shortcomings:

1. The device includes more components than conventional one so that the size of each component required minimized within the same size. Thus the strength of each component is reduced.
2. With more components, the manufacturing cost is increased accordingly. For example, mold cost is raised.
3. The complicated structure causes difficulty in assembling. Thus the assembling processes are labor-consuming and time-consuming.
4. Relative movements among each component result in wear and this would shorten use life of the device and the device is easy to be out of order.

SUMMARY OF THE INVENTION

Therefore it is a primary object of the present invention to provide a protective member for automatic open close umbrellas with anti-springing effect that includes a ratchet, a string and a locking member. The ratchet with an elastic member therein is mounted in a handle. A bottom end of the string is wound around the ratchet elastically while a top end thereof is fixed on an upper part of an outer tube of an umbrella shaft. The locking member is reverse L-shaped and is arranged with an elastic member therein. The locking member is formed by an upper part and a lower part. A middle axle is set between the upper part and the lower part t, and is mounted axially in the handle. When the umbrella shaft is extended from a closed state, a top surface of an upper part of the locking member contacts with a tip of a fastener while a bottom of a lower part of the locking member is separated from ratchet teeth of the ratchet. When the umbrella shaft is gradually shortened from an extended state, the top surface of the upper part of the locking member is separated from the fastener while the bottom of the lower part is locked to one of the ratchet teeth of the ratchet elastically. By the tip of the fastener leaning against the upper part of the locking member, the locking member pivots by a middle axle, used as a first-class lever. Moreover, the fastener is not disposed with an insertion hole so that the tip thereof is not easily worn out. Thus the present invention can work more precisely and the movement is more stable than prior arts.

It is another object of the present invention to provide a protective member for automatic open close umbrellas with anti-springing effect, in which the connection, the structure and the movement among the ratchet, the string and the locking member are simplified. Thus under limited space inside the handle, the size of each component is increased so as to increase the strength. Moreover, the device can be assembled easily, the cost is reduced, and both safety and life are increased.

It is a further object of the present invention to provide a protective member for automatic open close umbrellas with anti-springing effect, in which a top end of the string is fixed on a bottom end of a core tube in the umbrella shaft.

BRIEF DESCRIPTION OF THE DRAWINGS

FIG. 12 is a cross sectional view of an embodiment when an umbrella is in an open state according to the present invention;

FIG. 13 is a partial enlarged view of the embodiment in FIG. 12;

FIG. 14 is a partial enlarged view of the embodiment in FIG. 12 from another angle of view (left side);

DETAILED DESCRIPTION OF THE PREFERRED EMBODIMENT

Figure 2:
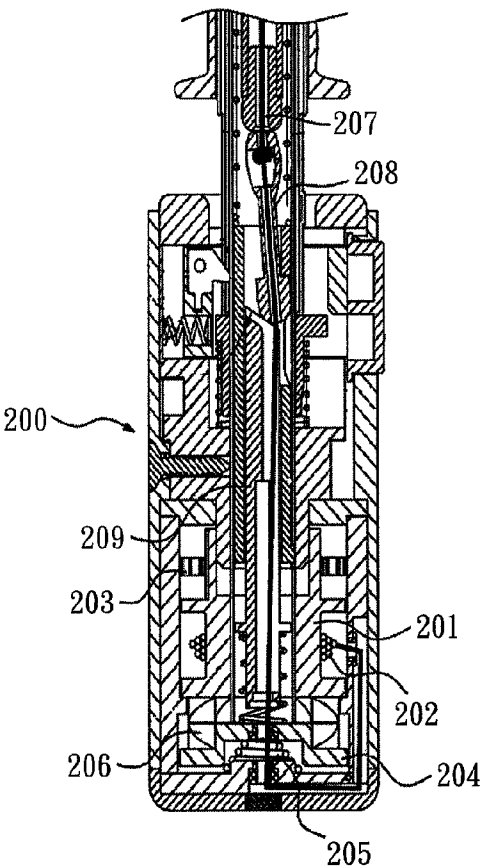
FIG. 2(PRIOR ART)
FIG. 1 to FIG. 5 show structure of various prior arts of a protective member for automatic open close umbrellas that prevents an umbrella shaft from springing back effectively.
Figure 1:
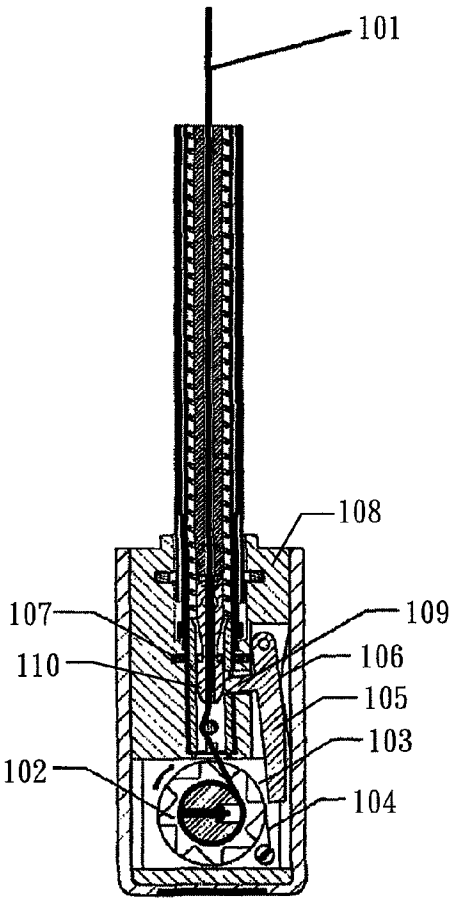
FIG. 1(PRIOR ART)
Figure 4:
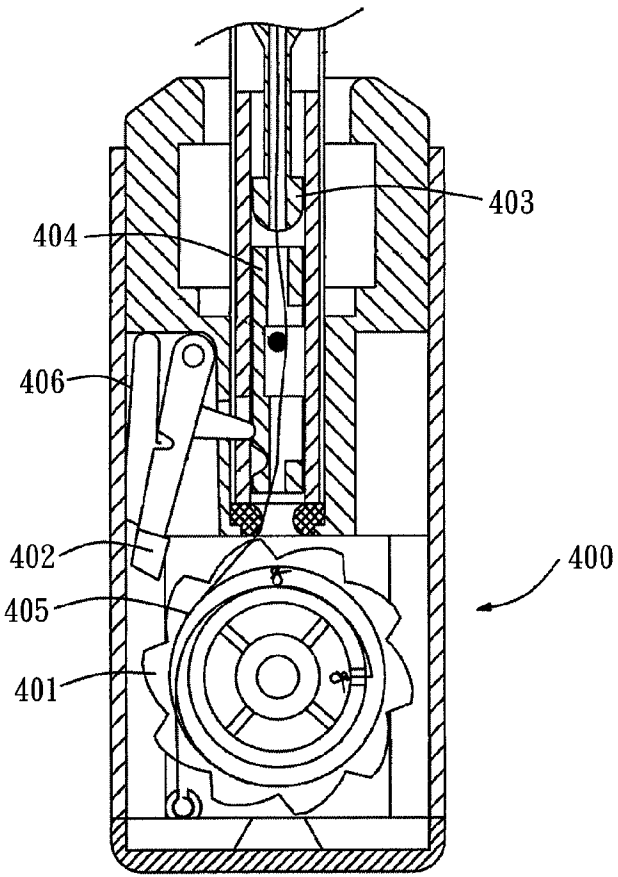
FIG. 4(PRIOR ART)
Figure 3:
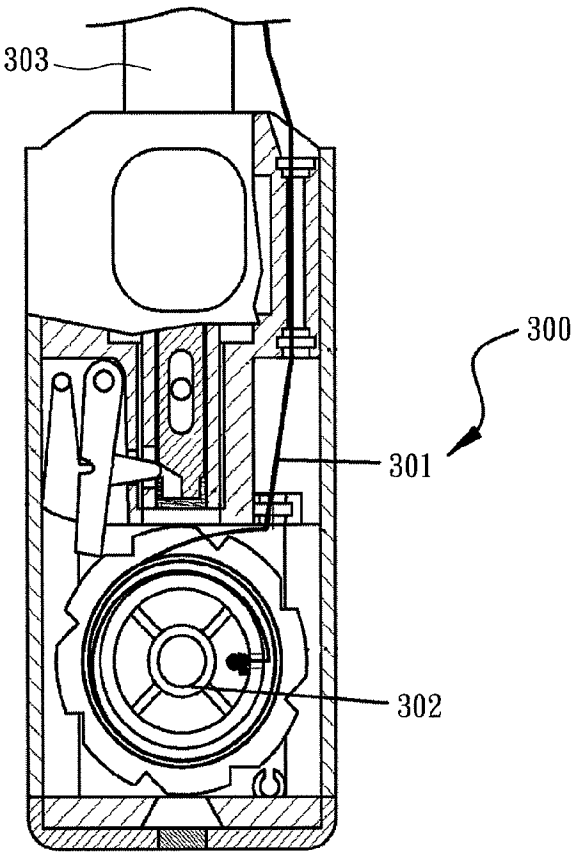
FIG. 3(PRIOR ART)
Figure 5:
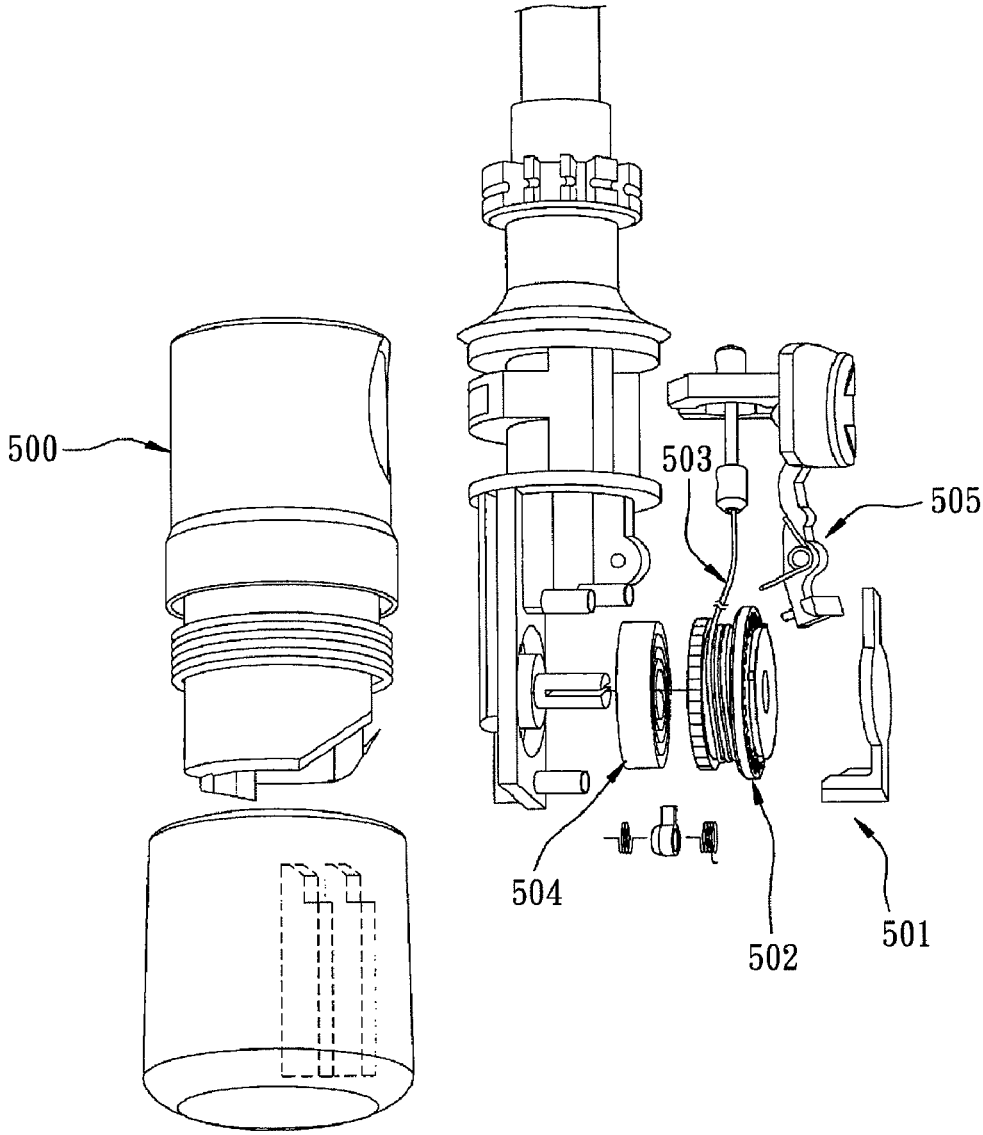
FIG. 5(PRIOR ART)
Figure 6:
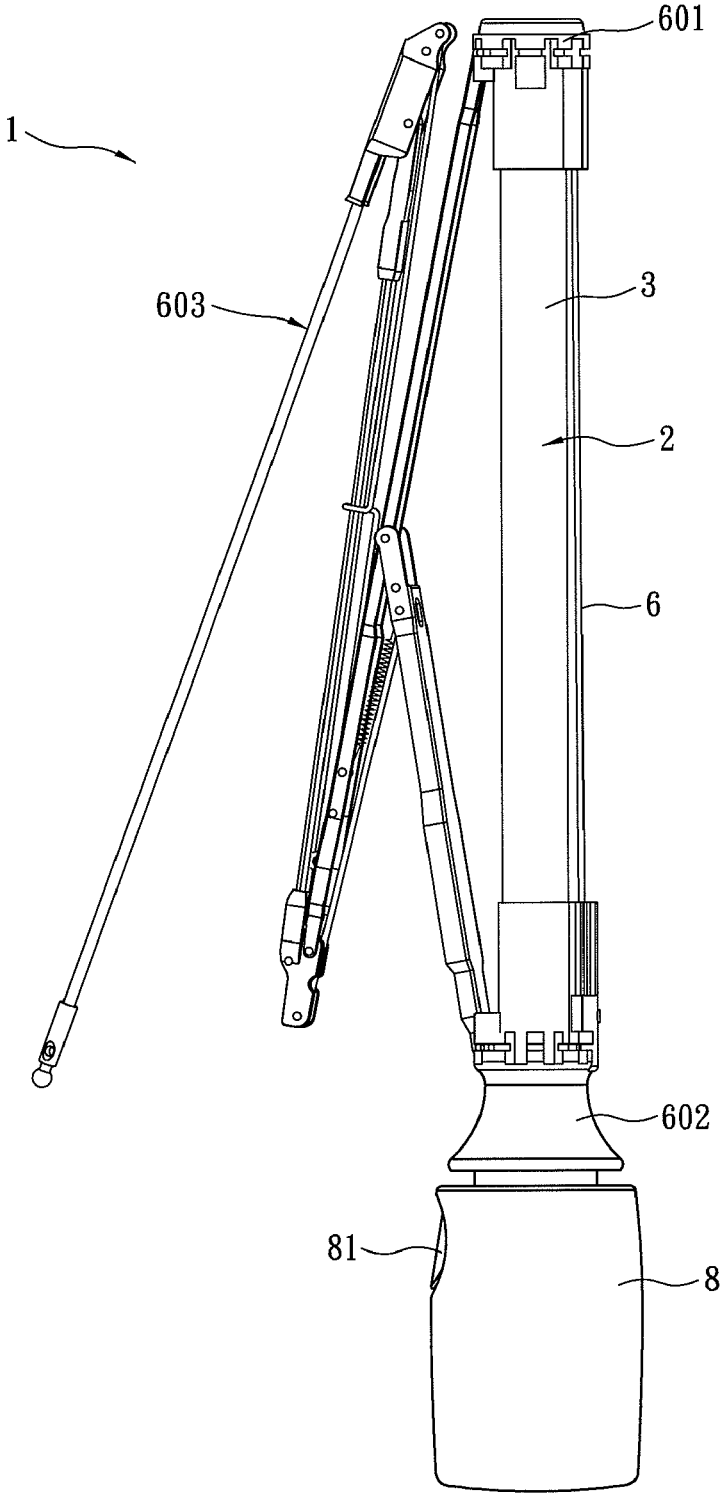
FIG. 6 is a perspective view of an embodiment according to the present invention.
Figure 7:
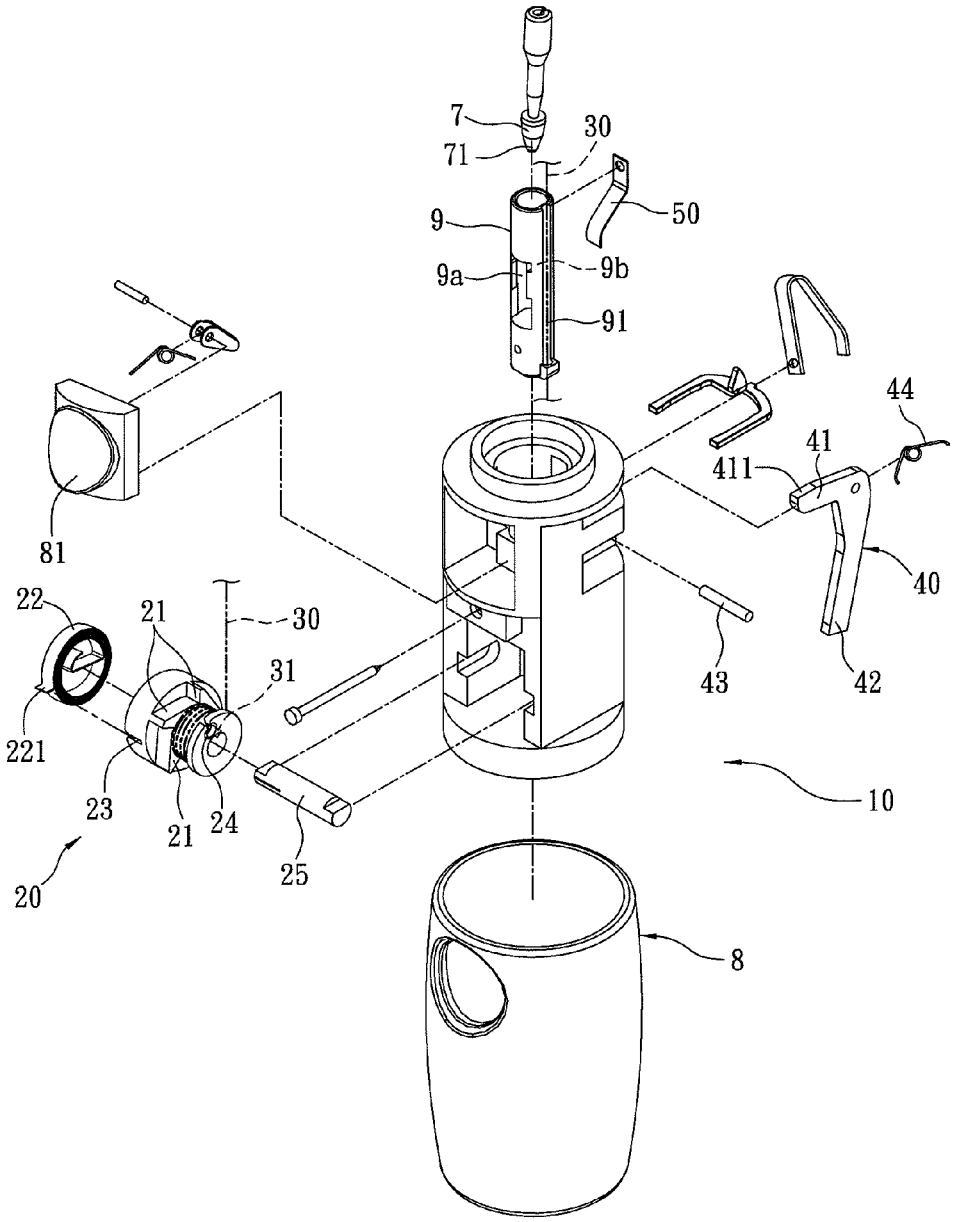
FIG. 7 is an explosive view of an automatic open close umbrella according to the present invention.
Figure 8:
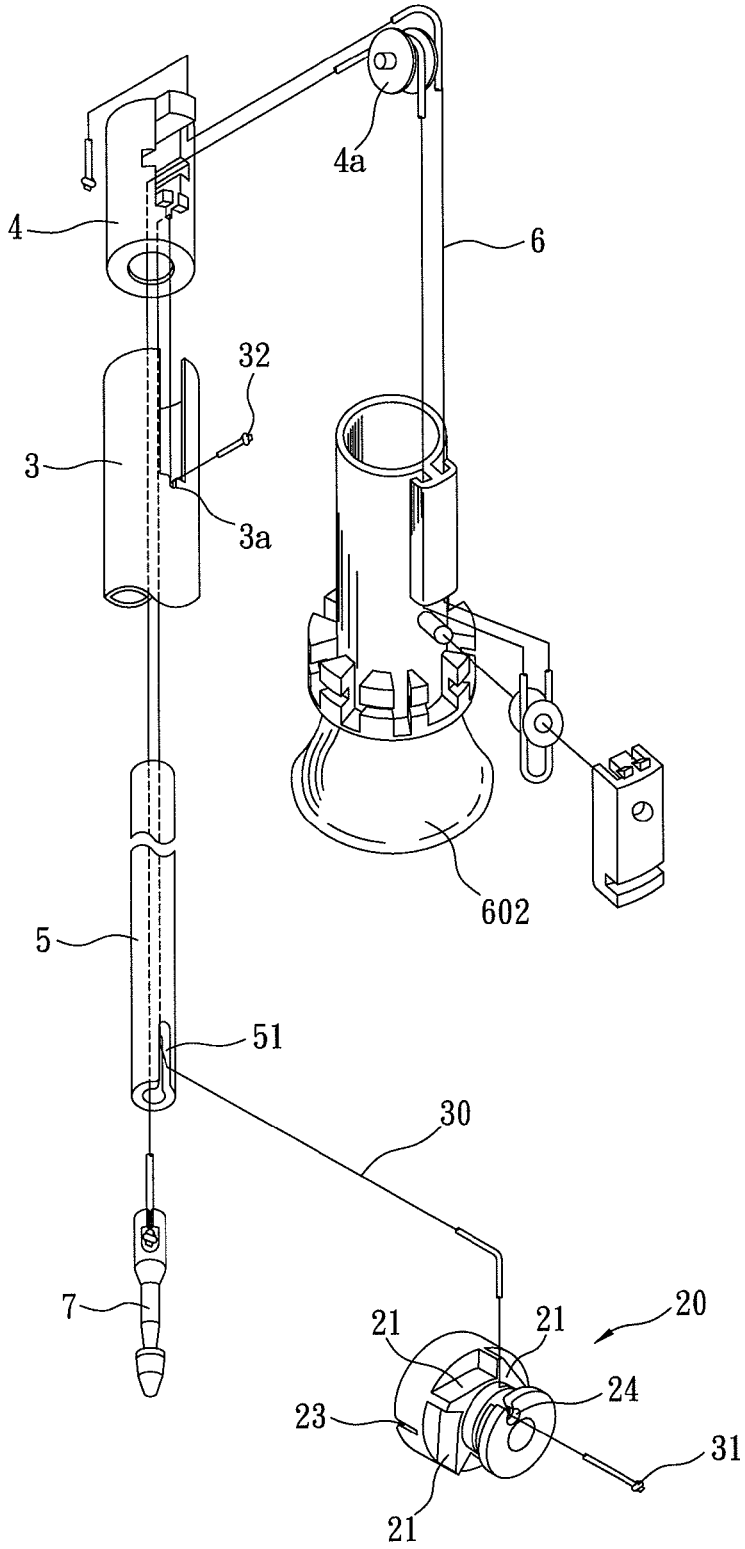
FIG. 8 is a partial explosive view of an embodiment according to the present invention.

A protective device for automatic open close umbrellas is applied to a folding umbrella such as three folding umbrella but not limited to. In this embodiment, a three folding umbrella is used as an example. In figures, only a left side of an umbrella frame is displayed while the right side thereof is omitted because the umbrella frame has symmetrical structure.

Refer from FIG. 6 to FIG. 11, an automatic open close umbrella 1 generally includes an umbrella shaft 2 formed by an outer tube 3, a middle tube and an inner tube sleeved with one another, an upper runner 601 fixed on the top of the umbrella shaft 2, a lower runner 602 sliding and arranged around the umbrella shaft 2, and an umbrella frame 603. The upper runner 601, the lower runner 602 and the umbrella frame 603 form a connecting structure. An upper pulley base 4 is disposed on the top of the outer tube 3 while a core tube 5 mounted in the outer tube 3 and connected with the bottom of the upper pulley base 4 moves along with the outer tube 3 synchronously. An opening spring 604 is arranged between the umbrella shaft 2 and the core tube 5. A main string 6 has one end fixed on the upper pulley base 4 and the other end passes one side of the umbrella shaft 2, the lower runner 602, moving upward to go through a pulley 4*a* inside the upper pulley base 4, inner surface of the umbrella shaft 2 and finally connect with a fastener looking like a bullet 7. A handle 8 with a control tube 9 therein is arranged at a bottom of the umbrella shaft 2. The top of the control tube 9 is assembled with the bottom of the umbrella shaft 2 and is used for receiving the fastener 7. A slot 9*a* and a corresponding slot 9*b* are mounted on two side walls of the control tube 9 so as to lock with the fastener 7 and assemble with a leaf spring 50. When the fastener 7 is mounted into the slot 9*a*, the leaf spring 50 leans against one side of the fastener 7 firmly. A vertical groove 91 is disposed on an outer surface of one side wall of the control tube 9, penetrating the control tube 9. The handle 8 is arranged with a button 81 that controls opening and closing of the automatic open close umbrella 1. The disposition of above components is similar to that of general automatic umbrellas.

A protective device 10 with anti-springing effect according to the present invention consists of a ratchet 20, a string 30 and a locking member 40. The ratchet 20 is arranged in the handle 8 by a shaft 25. The ratchet 20 is disposed with a plurality of uniform-distributed one-way ratchet teeth 21 around thereof and having an elastic member 22 such as spiral spring, but not limited to, therein. By elasticity of the elastic member 22, the ratchet 20 is driven to rotate forward so that the string 30 is gradually wound around an axle of the ratchet 20. A nick 23 for locking an outer edge 221 of the elastic member 22 is disposed on an outer surface on one side of the ratchet 20. A nick 24 for locking and fixing a knot 31 on a bottom end of the string 30 is arranged at an outer surface on a front side of the ratchet 20.

The bottom end of the string 30 is fixed and the string 30 can be wound around an axle of the ratchet 20 elastically along with the forward rotation of the ratchet 20. The top end of the string 30 passes the groove 91 on the side wall of the control tube 9, along the inner surface of the umbrella shaft 2, through the core tube 5 and the upper pulley base 4 to be fixed on the outer tube 3. Moreover, the top end of the string 30 is disposed with a knot 32 so as to be locked in an open slot 3*a* on an upper part of the outer tube 3. The fixing way of the top end of the string 30 is different from that of prior arts. While in assembly, the string 30 and the original main string 6 can be fixed respectively by assembly devices or tolls available now. The top end of the string 30 is a feature of the present invention. The string 30 is wound around the axle of the ratchet 20 along with the forward rotation of the ratchet 20. The lower end of the core tube 5 is disposed with an open slot 51 so that the top end of the string 30 enter the core tube 5 through the open slot 51 so as to avoid contact with the upper part of the fastener 7 that causes wear and damage.

The locking member 40 disposed axially in the handle 8 is in a reverse L-shape and is having an elastic member 44 that provides an elastic recovery force after pivoting. The locking member 40 consists of an upper part 41, a lower part 42 and a middle axle 43 that is set between the upper part 41 and the lower part 42, acting like a first-class lever. That means the fulcrum is between the force and the load. The upper part 41 is horizontally against the bottom of the umbrella shaft 2 so that a top surface 411 of the upper part 41 faces a tip 71 of the fastener 7. Thus the tip 71 can lean against the top surface 411 directly. The bottom of the lower part 42 is used to be locked to one of the ratchet teeth 21 of the ratchet 20 correspondingly.

Figure 10:
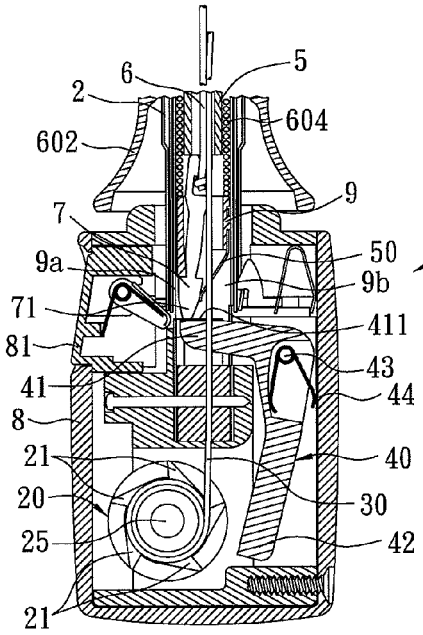
FIG. 10 is a partial enlarged view of the embodiment in FIG. 9.
Figure 11:
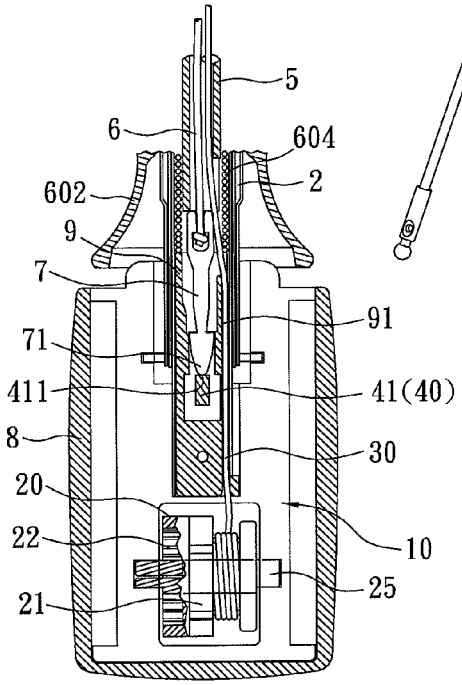
FIG. 11 is a partial enlarged view of the embodiment in FIG. 9 from another angle of view (left side)
Figure 9:
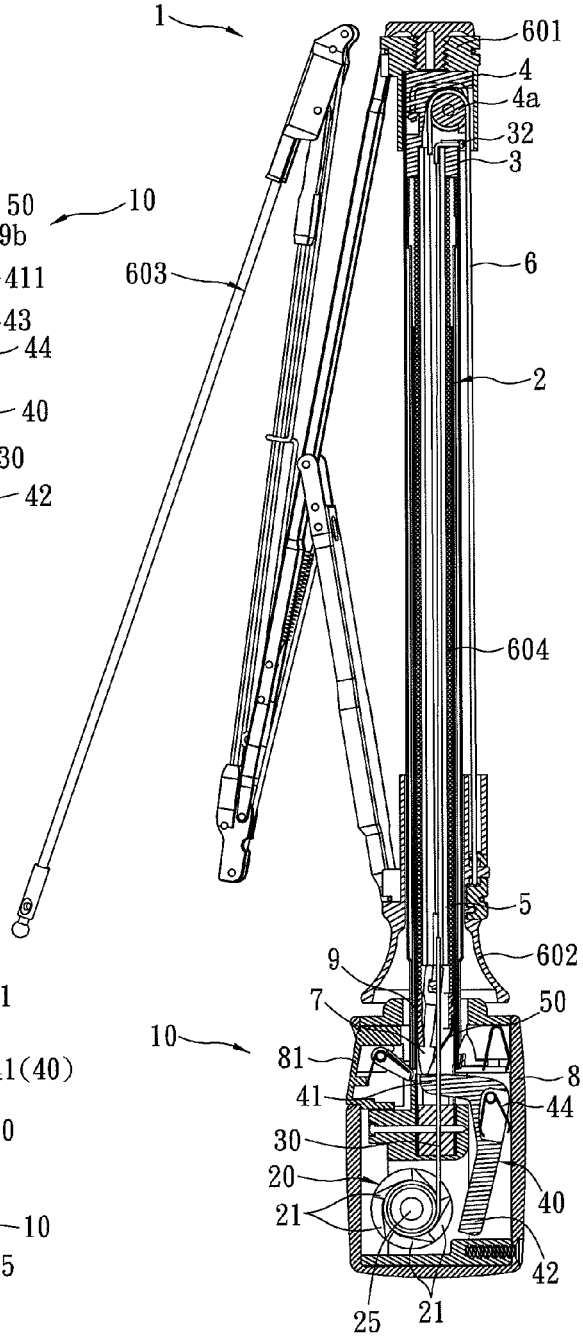
FIG. 9 is a cross sectional view of the embodiment in FIG. 6.

Refer from FIG. 9 to FIG. 11, the automatic open close umbrella 1 is closed. The fastener 7 is located in the control tube 9 and is locked in the slot 9*a*. Now the bottom of the core tube 5 leans against the top of the fastener 7 so that the tip 71 of the fastener 7 is against the top surface 411 of the locking member 40 and is driving the bottom of the lower part 42 of the locking member 40 to move, not engaged with the ratchet tooth 21 of the ratchet 20 by the pivoted middle axle 43. The bottom end of the string 30 is retracted and wound around the axle of the ratchet 20.

Refer from FIG. 12 to FIG. 14, the automatic open close umbrella 1 is open by pressing the button 81. Due to the extension force of the opening spring 604, the umbrella shaft 2 is driven to extend upward. Then the outer tube 3, the upper runner 601, and the upper pulley base also moves upward along with the umbrella shaft 2 synchronously. Moreover, pull the main string 6 to drive the lower runner 602 moving toward the upper runner 601. The top end of the string 30 is driven to move upward and the bottom end of the string 30 is gradually released from the axle of the ratchet 20. But now the fastener 7 is still locked in the slot 9*a* (the main string 6 is stretched taut) and the bottom of the lower part 42 of the locking member 40 is not engaged with the ratchet tooth 21 of the ratchet 20.

Figure 16:
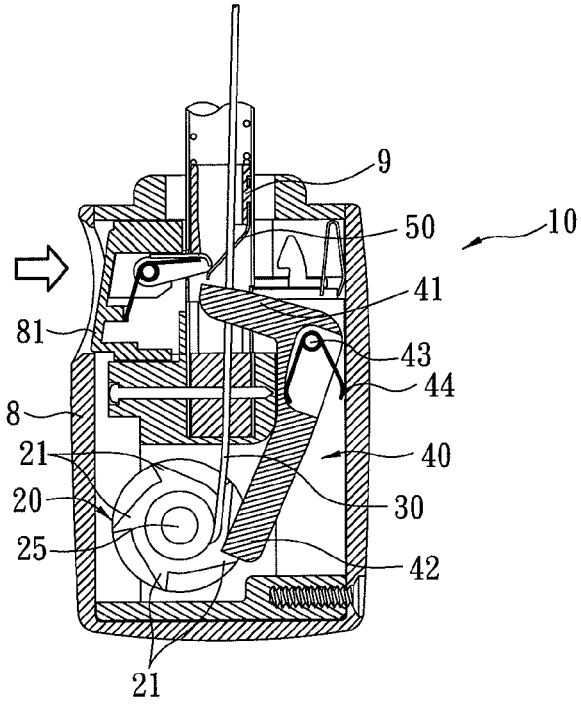
FIG. 16 is a partial enlarged view of the embodiment in FIG. 15.
Figure 15:
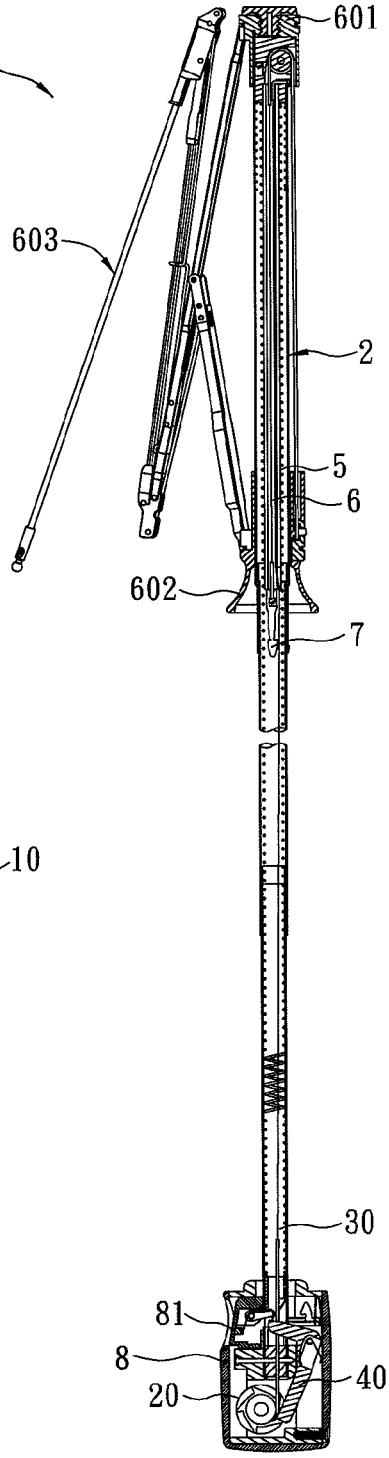
FIG. 15 is a cross sectional view of an embodiment when an umbrella is closed according to the present invention.

Refer to FIG. 15 and FIG. 16, under an open state shown in FIG. 12, press the button 81 again so as to fold the umbrella frame 603 beside the umbrella shaft 2 while the umbrella shaft 2 is in an extended state. The fastener 7 is pushed and moved by the button 81, released from the slot 9*a*, and pulled upward by the main string 6 to be released from the top surface 411 of the locking member 40. By the elastic recovery force of the elastic member 44, the locking member 40 pivots so that the bottom of the lower part 42 is locked to one ratchet tooth 21 of the ratchet 20.

Figure 18:
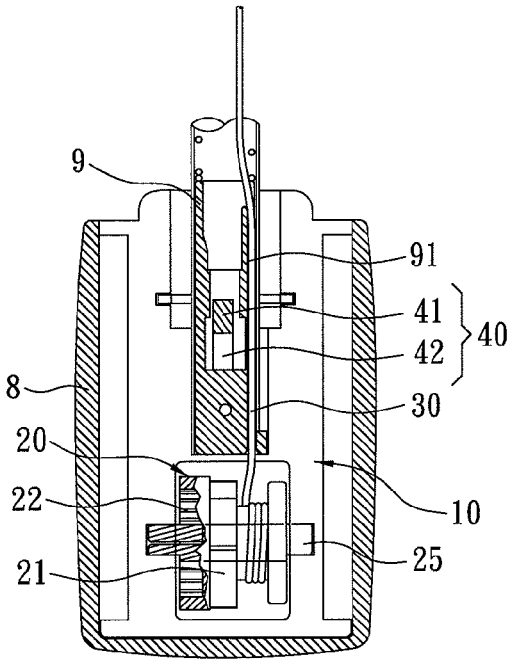
FIG. 18 is a partial enlarged view of the embodiment in FIG. 17.
Figure 17:
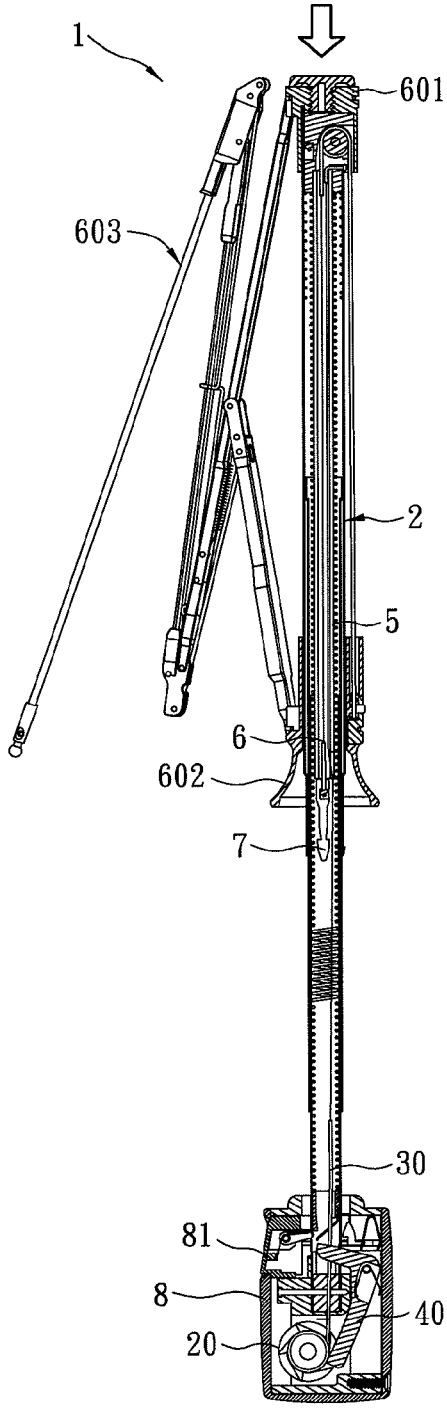
FIG. 17 is a cross sectional view of an embodiment when an umbrella shaft is shortened according to the present invention.

Refer from FIG. 17 and FIG. 18, the umbrella shaft 2 in the extended state returns to the compressed state. The umbrella shaft 2 is gradually shortened and the core tube 5 synchronously drives the fastener 7 to move downward. By the elasticity of the elastic member 22 inside, the ratchet 20 rotates forward so as to wind the string 30 around the axle steadily. Along with the forward rotation of the ratchet 20, the bottom of the lower part 42 of the locking member 40 keeps locked to the next ratchet tooth 21 of the ratchet 20. Thereby, at any point during the shortened processes of the umbrella shaft 2, once the closing force applied to the umbrella shaft 2 disappears no matter due to improper operation or other reasons, the ratchet 20 can be locked elastically by the bottom of the lower part 42 of the locking member 40 and unable to move in the opposite direction. This prevents the umbrella shaft 2 from extending outward which may scare or hurt the user. Thus a certain protective effect is achieved and the umbrella is opened/closed with safety.

Figure 19:
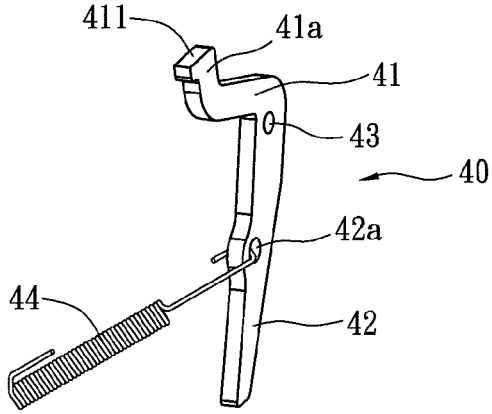
FIG. 19 is a perspective view of another embodiment of a locking member of a protective device according to the present invention.
Figure 20:
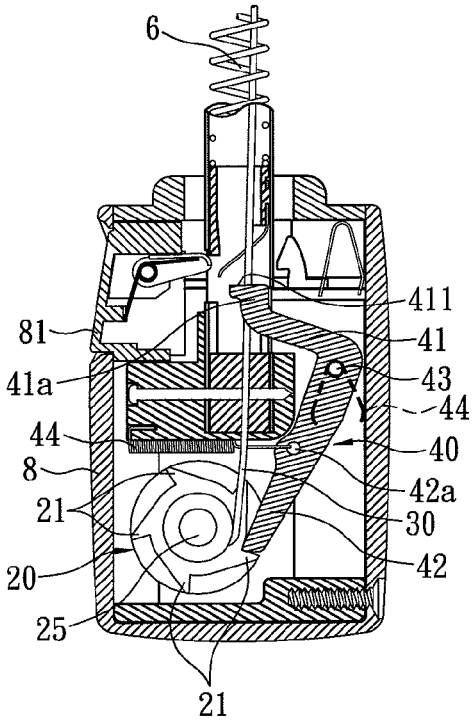
FIG. 20 and FIG. 21 are cross sectional views showing movement of the locking member.
Figure 21:
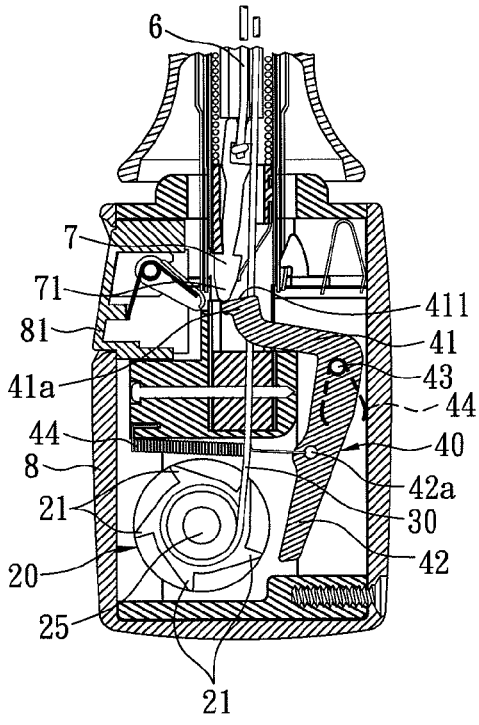

Refer from FIG. 19 to FIG. 21, a locking member 40 in this embodiment has the design different from that of the locking member 40 in the embodiment shown from FIG. 6 to FIG. 18 while with similar function. The locking member 40 is reverse L-shaped, working as a first-class lever and having an elastic member 44 for providing elastic recovery force after pivoting. The position of the locking member 40 is not limited, can be on the middle axle 43, as shown in FIG. 6 to FIG. 18. Or the elastic member 44 can be replaced by an extension spring, as shown from FIG. 19 to FIG. 21, one end thereof is fixed on the handle 8 while the other end thereof is connected with a locating hole 42*a* between the middle axle 43 and the bottom of the lower part 42. In this embodiment, the locking member 40 features on that the upper part 41 thereof form an upward extending end 41*a* and an end surface of the extending end 41*a* is used as a top surface 411. That means the end surface of the extending end 41*a* can replace the top surface 411 from FIG. 6 to FIG. 18. Thus the end surface 411 faces the tip 71 of the fastener 7 to be against directly by the tip 71.

Figure 22:
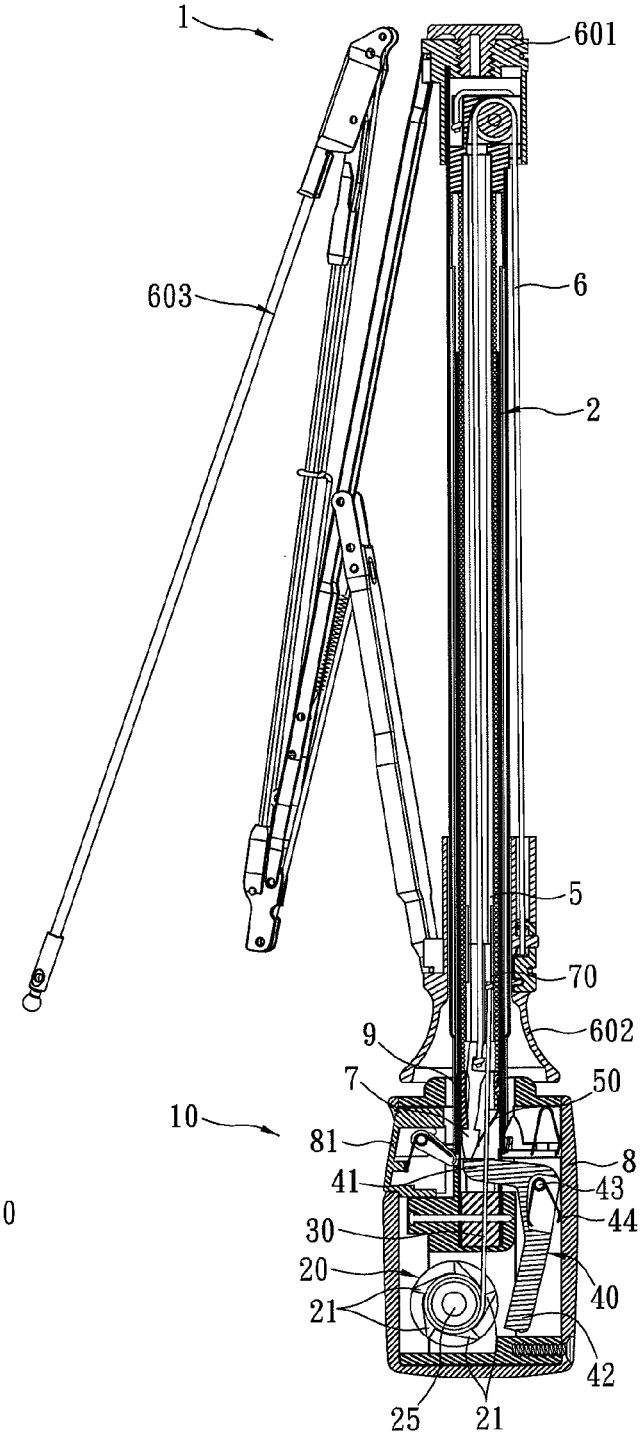
FIG. 22 is an explosive view of another embodiment in which a string is fixed on a bottom end of a core tube according to the present invention.

Refer to FIG. 22, this embodiment has similar structure with the above embodiment. The difference between this embodiment and the above one is in that the top end of the string 30 passes the groove 91 of the control tube 9 to be fixed on the bottom end of the core tube 5 while the bottom end of the string 30 is similarly fixed and elastically wound around the axle of the ratchet 20.

Figure 23:
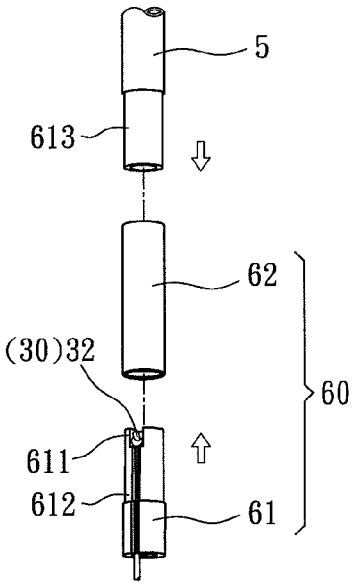
FIG. 23 is an explosive view of a fix assembly of the embodiment in FIG. 22.

Refer to FIG. 23, the bottom end of the core tube 5 is further disposed with a fix assembly 60 so as to fix the top end of the string 30 on the bottom of the core tube 5 easily. The fix assembly 60 is composed of at least one tubular member 61 with an open slot 611 on the top end thereof for locking the knot 32 on the top end of the string 30 before being assembled with the bottom end of the core tube 5. As shown in FIG. 23, the fix assembly 60 includes a first tubular member 61 and a second tubular member 62. Besides the open slot 611 on the top end, the first tubular member 61 further includes a neck 612 while a neck 613 is also formed on the bottom end of the core tube 5. While assembling, the knot 32 on the top end of the string 30 extends upward in the first tubular member 61 and crosses the open slot 611 on the top end of the first tubular member 61. Then the neck 612 is sleeved into the bottom end of the second tubular member 62 so as to fix the knot 32 on the top end of the string 30 firmly between the first tubular member 61 and the second tubular member 62. The top end of the second tubular member 62 is sleeved and assembled with the neck 613 on the bottom end of the core tube 5.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A protective member for automatic open close umbrellas with anti-springing effect comprising a ratchet, a string and a locking member; the automatic open close umbrella comprising an umbrella shaft having at least an outer tube, a middle tube and an inner tube sleeved and assembled with one another, an upper runner disposed on top of the umbrella shaft, and a lower runner sliding around the umbrella shaft; the upper runner, the lower runner and an umbrella frame form a connecting structure;

an upper pulley base is disposed on top of the outer tube while a core tube moving along with the outer tube synchronously is fixed on bottom of the upper pulley base; a main string having one end fixed on the upper pulley base and the other end thereof passes downward through the lower runner, moving upward to go through the upper pulley base and downward connecting with a fastener; a handle with a control tube therein is arranged at a bottom of the umbrella shaft with the control tube having a top end connected with the bottom of the umbrella shaft;

a button is disposed on the handle for control of opening and closing of automatic open close umbrellas;

wherein the ratchet is mounted in the handle and the ratchet having an elastic member for driving the ratchet rotating forward and a plurality of uniform-distributed one-way ratchet teeth arranged around thereof;

a bottom end of the string is fixed on the ratchet to be wound there around while a top end of the string passes along an inner space of the umbrella shaft to be fixed on an open slot on an upper part of the outer tube;

the locking member is reverse L-shaped, disposed with an elastic member that provides an elastic recovery force for turning back and having an upper part, a lower part and a middle axle between the upper part and the lower part for being mounted in the handle axially and being a first-class lever; the upper part of the locking member is horizontally against the bottom of the umbrella shaft so that the fastener leans against a top surface of the upper part of the locking member;

when the umbrella shaft changes from a closed state to an extended state, a tip of the fastener leans against the top surface of the upper part of the locking member so as to drive the locking member to pivot about the middle axle to move outward so that a bottom end of the lower part is released from one of the ratchet teeth of the ratchet;

when the umbrella shaft changes from the extended state to the closed state, the tip of the fastener is separated from the top surface of the upper part of the locking member while the locking member moves in and turns back by the elastic member of the locking member so that the bottom end of the lower part moves in the direction of forward rotation of the ratchet and is locked to a next of the ratchet teeth for preventing the ratchet from rotating in the opposite direction.

2. The device as claimed in claim 1, wherein an axial groove extending vertically is disposed on an outer surface of a side wall of the control tube and the axial groove allows the string to pass therethrough.

3. The device as claimed in claim 1, wherein a nick for locking an outer edge of the elastic member is disposed on an outer surface on one side of the ratchet.

4. The device as claimed in claim 1, wherein a nick for locking and fixing a knot on a bottom end of the string is arranged at an outer surface on a front side of the ratchet.

5. The device as claimed in claim 1, wherein an open slot is disposed on a lower end of the core tube so that the top end of the string passes through the open slot and then enters the core tube.

6. The device as claimed in claim 1, wherein the top end of the string extends upwardly in an inner space of the umbrella shaft to be fixed on a bottom end of the core tube.

7. The device as claimed in claim 6, wherein a fix assembly is arranged on the bottom end of the core tube and the fix assembly includes at least one tubular member with an open slot on a top end thereof for locking the knot on the top end of the string so as to fix the top end of the string on the bottom end of the core tube.

8. The device as claimed in claim 7, wherein the fix assembly further includes a first tubular member and a second tubular member; the first tubular member is disposed with an open slot on the top end thereof for locking the knot on the top end of the string therein while the second tubular member is connected between a bottom end of the core tube and a top end of the first tubular member.

9. The device as claimed in claim 1, wherein the upper part of the locking member extends forward to form an extending end and an end surface of the extending end is used as the top surface of the upper part that is against by the fastener.

10. The device as claimed in claim 1, wherein the elastic member of the locking member is an extension spring whose one end is fixed on the handle and the other end is connected with a locating hole between the middle axle and the bottom of the lower part.

* * * * *